US010895251B2

(12) United States Patent
Kuo et al.

(10) Patent No.: US 10,895,251 B2
(45) Date of Patent: Jan. 19, 2021

(54) DEVICE FOR ACCUMULATING ATMOSPHERIC PRESSURE

(71) Applicant: National Taiwan Normal University, Taipei (TW)

(72) Inventors: Chin-Guo Kuo, Taipei (TW); Jung-Hsuan Chen, Taipei (TW); Chao-Fu Shu, Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 149 days.

(21) Appl. No.: 16/178,017

(22) Filed: Nov. 1, 2018

(65) Prior Publication Data

US 2020/0080548 A1 Mar. 12, 2020

(30) Foreign Application Priority Data

Sep. 11, 2018 (TW) ..... 107131802 A

(51) Int. Cl.
*F04B 41/06* (2006.01)
*F04B 39/12* (2006.01)
*F04B 39/10* (2006.01)

(52) U.S. Cl.
CPC ..... *F04B 41/06* (2013.01); *F04B 39/10* (2013.01); *F04B 39/123* (2013.01)

(58) Field of Classification Search
CPC ..... F04B 33/00; F04B 39/10; F04B 39/123; F04B 41/06
USPC ..... 417/374
See application file for complete search history.

(56) References Cited

U.S. PATENT DOCUMENTS 5,445,505 A * 8/1995 Hung ..... F04B 9/123 417/374
9,126,626 B1 * 9/2015 Dieleman ..... B60P 3/40
2018/0340528 A1 * 11/2018 Wang ..... F04B 39/14

FOREIGN PATENT DOCUMENTS

TW M502957 U 6/2015

* cited by examiner

*Primary Examiner* — Patrick Hamo
(74) *Attorney, Agent, or Firm* — Muncy, Geissler, Olds & Lowe, P.C.

(57) ABSTRACT

A device for accumulating atmospheric pressure includes a supporting device, at least two expandable chambers, a five-opening air valve, and an exhauster. The expandable chambers are installed on the supporting device. The number of the expandable chambers is an even number. The expandable chambers are uniformly arranged at two opposite sides of the supporting device. The five-opening air valve is connected with the expandable chambers to communicate with the internal spaces of the at least two expandable chambers, and receives atmospheric pressure. The exhauster connects and communicates with the five-opening air valve. According to the switching state of the five-opening air valve, the exhauster exhausts the internal space of one of the expandable chambers through the five-opening air valve or the atmospheric pressure inflates the internal space of one of the expandable chambers through the five-opening air valve, thereby driving the supporting device.

9 Claims, 6 Drawing Sheets

DEVICE FOR ACCUMULATING ATMOSPHERIC PRESSURE

This application claims priority for Taiwan patent application no. 107131802 filed on Sep. 11, 2018, the content of which is incorporated by reference in its entirety.

BACKGROUND OF THE INVENTION

Field of the Invention

The present invention relates to an accumulating device, particularly to a device for accumulating atmospheric pressure.

Description of the Related Art

In the conventional technology, the application of atmospheric pressure mostly uses compressed pressure to generate power in a fixed chamber. The volumetric variation of the chamber accompanies friction, which causes the power loss and heat.

Take Taiwan patent No. M502957 as an example. The patent disclosed a pneumatic lifting device comprising a base, a pneumatic lifting module, a supporting platform, and a plurality of auxiliary supporting modules. The pneumatic lifting module is arranged on the base. The pneumatic lifting module has an actuating end. The supporting platform is combined with the actuating end of the pneumatic lifting module. Each auxiliary supporting module has a guiding base, a supporting member, and a slider. The guiding base is arranged on the base. The guiding base is provided with a guiding groove and a penetrating groove. The supporting member is arranged in the guiding base. An end of the supporting member is connected with the supporting platform. The slider is arranged in the penetrating groove and driven to horizontally move. The pneumatic lifting module uses compressed gas as power. When the pneumatic lifting module lifts, the power loss will be produced. Besides, in order to produce high power, the pneumatic lifting module needs to occupy a very large space, which is a drawback.

To overcome the abovementioned problems, the present invention provides a device for accumulating atmospheric pressure, so as to solve the afore-mentioned problems of the prior art.

SUMMARY OF THE INVENTION

The primary objective of the present invention is to provide a device for accumulating atmospheric pressure, which uses an exhauster to exhaust the internal spaces of at least two expandable chambers or uses atmospheric pressure to inflate the internal spaces of the expandable chambers, thereby accumulating force, avoiding the consumption of energy, and occupying a very large space.

To achieve the abovementioned objectives, the present invention provides a device for accumulating atmospheric pressure, which comprises a supporting device, at least two expandable chambers, a five-opening air valve, and an exhauster. The expandable chambers are installed on the supporting device, the number of the at least two expandable chambers is an even number, and the expandable chambers are uniformly arranged at two opposite sides of the supporting device. The five-opening air valve is connected with the expandable chambers to communicate with internal spaces of the expandable chambers, and receives atmospheric pressure. The exhauster connects and communicates with the five-opening air valve. According to the switching state of the five-opening air valve, the exhauster exhausts the internal space of one of the expandable chambers through the five-opening air valve or the atmospheric pressure inflates the internal space of one of the expandable chambers through the five-opening air valve, thereby driving the supporting device.

In an embodiment of the present invention, the five-opening air valve has a first opening, a second opening, a third opening, a fourth opening, a fifth opening, a first channel connected between the first opening and the second opening, a second channel connected between the second opening and the third opening, a third channel connected between the third opening and the fourth opening, and a fourth channel connected between the fourth opening and the fifth opening. The second opening and the fourth opening are respectively connected with the expandable chambers to communicate with the internal spaces of the expandable chambers, the first opening and the fifth opening receive the atmospheric pressure, and the exhauster is connected with the third opening. The expandable chambers further comprise a first expandable chamber and a second expandable chamber. The first interior of the first expandable chamber has a first closed space, the first exterior of the first expandable chamber has a first sectioning plate and a second sectioning plate opposite to the first sectioning plate, and the second opening connects with the first expandable chamber to communicate with the first closed space through a first soft pipe. The second interior of the second expandable chamber has a second closed space, the second exterior of the second expandable chamber has a third sectioning plate and a fourth sectioning plate opposite to the third sectioning plate, and the fourth opening connects with the second expandable chamber to communicate with the second closed space through a second soft pipe. The supporting device further comprises a supporting base, a supporting post, a first power lever, a first connecting rod, and a second connecting rod. The supporting base is fixed with the second sectioning plate thereon. The supporting post is fixed on the supporting base and vertically connected with the supporting base, the supporting post is penetrated with a first sleeving axle, the first expandable chamber and the second expandable chamber are respectively arranged at two opposite sides of the supporting post, and the fourth sectioning plate is fixed to the supporting base. The first power lever sleeves the first sleeving axle, two ends of the first power lever are respectively penetrated with a second sleeving axle and a third sleeving axle, and the first sleeving axle is located between the second sleeving axle and the third sleeving axle. An end of the first connecting rod sleeves the second sleeving axle, and another end of the first connecting rod is fixed to the first sectioning plate. An end of the second connecting rod sleeves the third sleeving axle, and another end of the second connecting rod is fixed to the third sectioning plate. When the five-opening air valve turns off the first channel and the third channel and turns on the second channel and the fourth channel, the exhauster exhausts the first closed space through the second channel and the first soft pipe, the first sectioning plate uses the atmospheric pressure to move toward the second sectioning plate and uses the first connecting rod, the first sleeving axle, and the second sleeving axle to swing the first power lever, the atmospheric pressure inflates the second closed space through the fourth channel and the second soft pipe, and the third sectioning plate uses the atmospheric pressure to move away from the fourth sectioning plate and uses the second connecting rod, the first sleeving axle, and the third sleeving axle to swing the first power lever. When the five-opening air valve turns on the first channel and the third channel and turns off the second channel and the fourth channel, the exhauster exhausts the second closed space through the third channel and the second soft pipe, the third sectioning plate uses the atmospheric pressure to move toward the fourth sectioning plate and uses the second connecting rod, the first sleeving axle, and the third sleeving axle to swing the first power lever, the atmospheric pressure inflates the first closed space through the first channel and the first soft pipe, and the first sectioning plate uses the atmospheric pressure to move away from the second sectioning plate and uses the first connecting rod, the first sleeving axle, and the second sleeving axle to swing the first power lever.

In an embodiment of the present invention, the five-opening air valve has a first opening, a second opening, a third opening, a fourth opening, a fifth opening, a first channel connected between the first opening and the second opening, a second channel connected between the second opening and the third opening, a third channel connected between the third opening and the fourth opening, and a fourth channel connected between the fourth opening and the fifth opening. The second opening and the fourth opening are respectively connected with the at least two expandable chambers to communicate with the internal spaces of the at least two expandable chambers, the first opening and the fifth opening receive the atmospheric pressure, the exhauster is connected with the third opening, and the at least two expandable chambers further comprises a first expandable chamber and a second expandable chamber. The first interior of the first expandable chamber has a first closed space, the first exterior of the first expandable chamber has a first sectioning plate and a second sectioning plate opposite to the first sectioning plate, and the second opening connects with the first expandable chamber to communicate with the first closed space through a first soft pipe. The second interior of the second expandable chamber has a second closed space, the second exterior of the second expandable chamber has a third sectioning plate and a fourth sectioning plate opposite to the third sectioning plate, and the second opening connects with the second expandable chamber to communicate with the second closed space through the first soft pipe. The supporting device further comprises a supporting base, a supporting post, a first supporting board, a first power lever, a first connecting rod, and a second connecting rod. The supporting base is fixed with the second sectioning plate thereon. The supporting post is fixed on the supporting base and vertically connected with the supporting base, the supporting post is penetrated with a first sleeving axle, and the first expandable chamber and the second expandable chamber are respectively arranged at two opposite sides of the supporting post. The first supporting board is vertically connected with the supporting post, the first supporting board and the first expandable chamber are respectively arranged at the two opposite sides of the supporting post, the first supporting board and the second expandable chamber are arranged at the identical side of the supporting post, the fourth sectioning plate is fixed to the first supporting board, and the second expandable chamber is arranged between the first supporting board and the supporting base. The first power lever sleeves the first sleeving axle, two ends of the first power lever are respectively penetrated with a second sleeving axle and a third sleeving axle, and the first sleeving axle is located between the second sleeving axle and the third sleeving axle. An end of the first connecting rod sleeves the second sleeving axle, and another end of the first connecting rod is fixed to the first sectioning plate. An end of the second connecting rod sleeves the third sleeving axle, and another end of the second connecting rod is fixed to the third sectioning plate. When the five-opening air valve turns off the first channel and turns on the second channel, the exhauster exhausts the first closed space and the second closed space through the second channel and the first soft pipe, and the first sectioning plate and the third sectioning plate use the atmospheric pressure to respectively move toward the second sectioning plate and the fourth sectioning plate and use the first connecting rod, the second connecting rod, the first sleeving axle, the second sleeving axle, and the third sleeving axle to swing the first power lever. When the five-opening air valve turns on the first channel and turns off the second channel, the atmospheric pressure inflates the first closed space and the second closed space through the first channel and the first soft pipe, and the first sectioning plate and the third sectioning plate use the atmospheric pressure to respectively move away from the second sectioning plate and the fourth sectioning plate and use the first connecting rod, the second connecting rod, the first sleeving axle, the second sleeving axle, and the third sleeving axle to swing the first power lever.

In an embodiment of the present invention, the at least two expandable chambers further comprise a third expandable chamber and a fourth expandable chamber. The third interior of the third expandable chamber has a third closed space, the third exterior of the third expandable chamber has a fifth sectioning plate and a sixth sectioning plate opposite to the fifth sectioning plate, the third expandable chamber and the first expandable chamber are arranged at the identical side of the supporting post, and the fourth opening connects with the third expandable chamber to communicate with the third closed space through a second soft pipe. The fourth interior of the fourth expandable chamber has a fourth closed space, the fourth exterior of the fourth expandable chamber has a seventh sectioning plate and an eighth sectioning plate opposite to the seventh sectioning plate, the fourth expandable chamber and the second expandable chamber are arranged at the identical side of the supporting post, the eighth sectioning plate is fixed on the supporting base, and the fourth opening connects with the fourth expandable chamber to communicate with the fourth closed space through the second soft pipe. The supporting device further comprises a second supporting board, a third connecting rod, and a fourth connecting rod. The second supporting board is vertically connected with the supporting post, the second supporting board and the first expandable chamber are arranged at the identical side of the supporting post, the sixth sectioning plate is fixed on the second supporting board, and the third expandable chamber is arranged between the second supporting board and the supporting base. An end of the third connecting rod sleeves the second sleeving axle, and another end of the third connecting rod is fixed to the fifth sectioning plate. An end of the fourth connecting rod sleeves the third sleeving axle, and another end of the fourth connecting rod is fixed to the seventh sectioning plate. When the five-opening air valve turns off the fourth channel and turns on the third channel, the exhauster exhausts the third closed space and the fourth closed space through the third channel and the second soft pipe, and the fifth sectioning plate and the seventh sectioning plate use the atmospheric pressure to respectively move toward the sixth sectioning plate and the eighth sectioning plate and use the third connecting rod, the fourth connecting rod, the first sleeving axle, the second sleeving axle, and the third sleeving axle to swing the first power lever. When the five-opening air valve turns on the fourth channel and turns off the third channel, the atmospheric pressure inflates the third closed space and the fourth closed space through the fourth channel and the second soft pipe, and the fifth sectioning plate and the seventh sectioning plate use the atmospheric pressure to respectively move away from the sixth sectioning plate and the eighth sectioning plate and use the third connecting rod, the fourth connecting rod, the first sleeving axle, the second sleeving axle, and the third sleeving axle to swing the first power lever.

Below, the embodiments are described in detail in cooperation with the drawings to make easily understood the technical contents, characteristics and accomplishments of the present invention.

BRIEF DESCRIPTION OF THE DRAWINGS

FIG. 1(*b*) is a diagram schematically showing a device for accumulating atmospheric pressure while inflating a first expandable chamber and exhausting a second expandable chamber according to the first embodiment of the present invention;

FIG. 2(*b*) is a diagram schematically showing a device for accumulating atmospheric pressure while inflating a first expandable chamber and a second expandable chamber according to the second embodiment of the present invention;

FIG. 3(*b*) is a diagram schematically showing a device for accumulating atmospheric pressure while exhausting a first expandable chamber and a second expandable chamber and inflating a third expandable chamber a fourth expandable chamber according to the third embodiment of the present invention.

DETAILED DESCRIPTION OF THE INVENTION

Figure 1A:
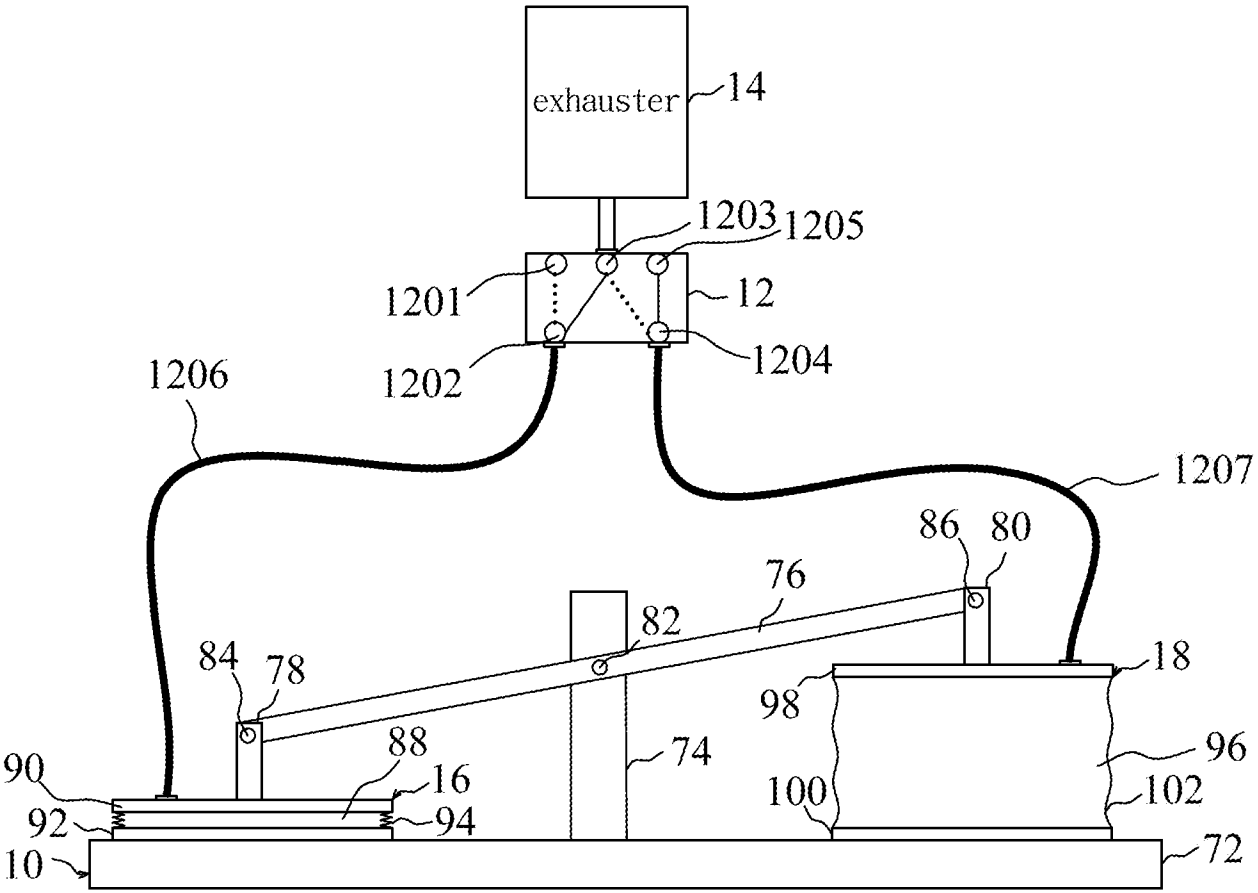
FIG. 1(*a*) is a diagram schematically showing a device for accumulating atmospheric pressure while exhausting a first expandable chamber and inflating a second expandable chamber according to the first embodiment of the present invention.

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Figure 1B:
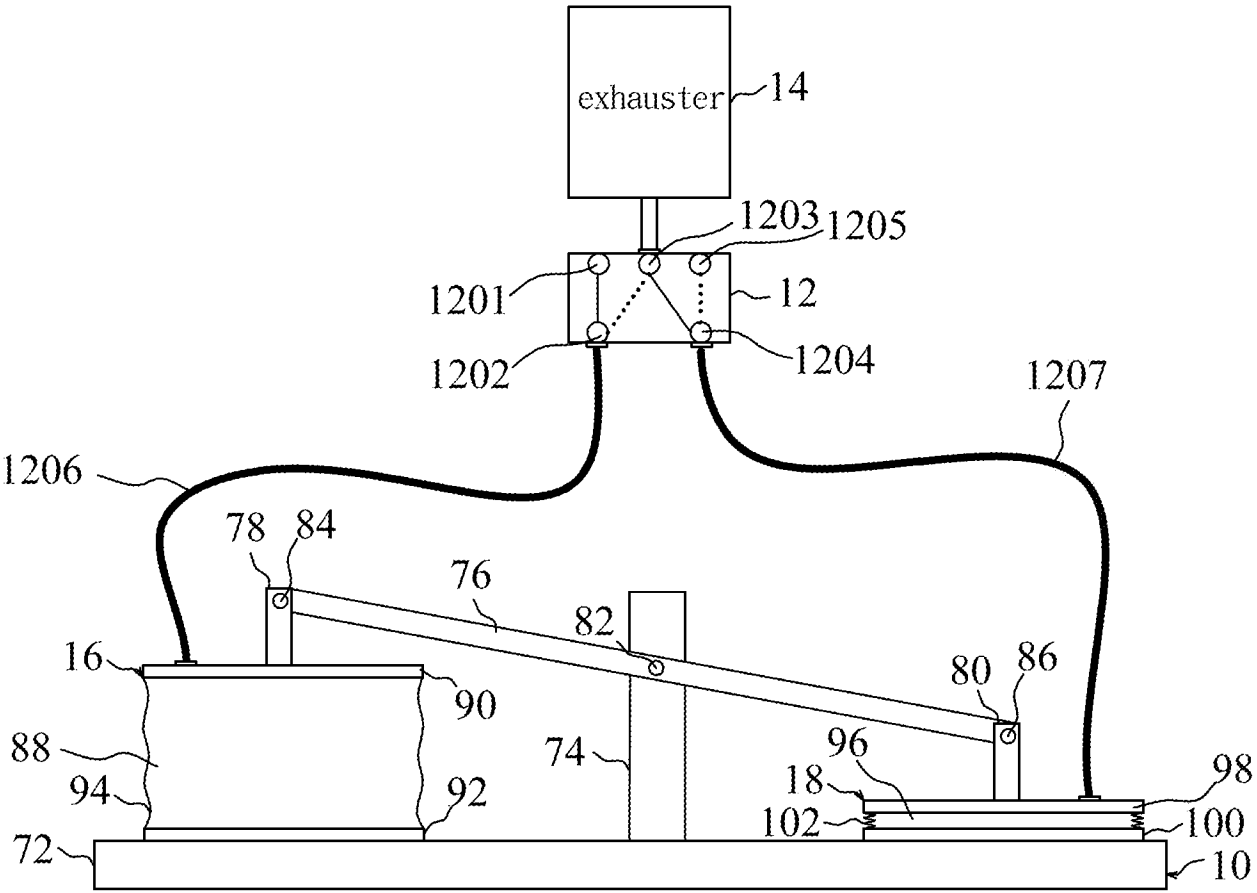

Refer to FIG. 1(*a*) and FIG. 1(*b*). The first embodiment of the device for accumulating atmospheric pressure is introduced as follows. The device for accumulating atmospheric pressure comprises a supporting device 10, at least two expandable chambers, a five-opening air valve 12, and an exhauster 14. The number of the expandable chambers is an even number. The expandable chambers are uniformly arranged at two opposite sides of the supporting device 10. Thus, not affected by the weight of the supporting device 10, the expandable chambers expand or contract. The five-opening air valve 12 is connected with the expandable chambers to communicate with internal spaces of the expandable chambers and receives atmospheric pressure. The exhauster 14 connects and communicates with the five-opening air valve 12. According to the switching state of the five-opening air valve 12, the exhauster 14 exhausts the internal space of one of the expandable chambers through the five-opening air valve 12 or the atmospheric pressure inflates the internal space of one of the expandable chambers through the five-opening air valve 12, thereby driving the supporting device 10. In the first embodiment, the expandable chambers comprise a first expandable chamber 16 and a second expandable chamber 18 installed on the supporting device 10. The five-opening air valve 12 has a first opening 1201, a second opening 1202, a third opening 1203, a fourth opening 1204, a fifth opening 1205, a first channel connected between the first opening 1201 and the second opening 1202, a second channel connected between the second opening 1202 and the third opening 1203, a third channel connected between the third opening 1203 and the fourth opening 1204, and a fourth channel connected between the fourth opening 1204 and the fifth opening 1205. The second opening 1202 and the fourth opening 1204 are respectively connected with the first expandable chamber 16 and the second expandable chamber 18 through a first soft pipe 1206 and a second soft pipe 1207, so as to communicate with the internal spaces of the first expandable chamber 16 and the second expandable chamber 18. The exhauster 14 connects and communicates with the third opening 1203. The first opening 1201 and the fifth opening 1205 receive the atmospheric pressure. The five-opening air valve 12 may be a manual air valve or an electric air valve. According to the switching state of the five-opening air valve 12, the exhauster 14 exhausts the internal space of the first expandable chamber 16 and the second expandable chamber 18 through the five-opening air valve 12 or the atmospheric pressure inflates the internal space of the first expandable chamber 16 and the second expandable chamber 18 through the five-opening air valve 12, thereby driving the supporting device 10.

Specifically, the supporting device 10 further comprises a supporting base 72, a supporting post 74, a first power lever 76, a first connecting rod 78, a second connecting rod 80, a first sleeving axle 82, a second sleeving axle 84, and a third sleeving axle 86. The first interior of the first expandable chamber 16 has a first closed space 88. The first exterior of the first expandable chamber 16 has a first sectioning plate 90, a second sectioning plate 92 opposite to the first sectioning plate 90, and a first expandable material 94. The second opening 1202 is connected with the first expandable chamber 16 through the first soft pipe 1206, so as to communicate with the first closed space 88. The first sectioning plate 90 and the second sectioning plate 92 are made of rigid material, such as stainless. The first expandable material 94 is soft and airtight. For example, the first expandable material 94 may be plastic. The first expandable material 94 is connected with the first sectioning plate 90 and the second sectioning plate 92. The first expandable material 94, the first sectioning plate 90, and the second sectioning plate 92 form the first closed space 88. The second interior of the second expandable chamber 18 has a second closed space 96. The second exterior of the second expandable chamber 18 has a third sectioning plate 98, a fourth sectioning plate 100 opposite to the third sectioning plate 98, and a second expandable material 102. The fourth opening 1204 is connected with the second expandable chamber 18 through the second soft pipe 1207, so as to communicate with the second closed space 96. The third sectioning plate 98 and the fourth sectioning plate 100 are made of rigid material, such as stainless. The second expandable material 102 is soft and airtight. For example, the second expandable material 102 may be plastic. The second expandable material 102 is connected with the third sectioning plate 98 and the fourth sectioning plate 100. The second expandable material 102, the third sectioning plate 98, and the fourth sectioning plate 100 form the second closed space 96.

The supporting base 72 is fixed with the second sectioning plate 92 thereon. The supporting post 74 is fixed on the supporting base 72 and vertically connected with the supporting base 72. The supporting post 74 is penetrated with the first sleeving axle 82. The first expandable chamber 16 and the second expandable chamber 18 are respectively arranged at two opposite sides of the supporting post 74, and the fourth sectioning plate 100 is fixed to the supporting base 72. The first power lever 76 sleeves the first sleeving axle 82, two ends of the first power lever 76 are respectively penetrated with the second sleeving axle 84 and the third sleeving axle 86, and the first sleeving axle 82 is located between the second sleeving axle 84 and the third sleeving axle 86. An end of the first connecting rod 78 sleeves the second sleeving axle 84, and another end of the first connecting rod 78 is fixed to the first sectioning plate 90. An end of the second connecting rod 80 sleeves the third sleeving axle 86, and another end of the second connecting rod 80 is fixed to the third sectioning plate 98.

The operation of the device for accumulating atmospheric pressure of the first embodiment of the present invention is introduced as follows. As shown in FIG. 1(*a*), when the five-opening air valve 12 turns off the first channel and the third channel and turns on the second channel and the fourth channel, the exhauster 14 exhausts the first closed space 88 through the second channel and the first soft pipe 1206, the first sectioning plate 90 uses the atmospheric pressure to move toward the second sectioning plate 92 and uses the first connecting rod 78, the first sleeving axle 82, and the second sleeving axle 84 to downward swing the first power lever 76, the atmospheric pressure inflates the second closed space 96 through the fourth channel and the second soft pipe 1207, and the third sectioning plate 98 uses the atmospheric pressure to move away from the fourth sectioning plate 100 and uses the second connecting rod 80, the first sleeving axle 82, and the third sleeving axle 86 to upward swing the first power lever 76. Thus, the first power lever 76 rotates counterclockwise. As shown in FIG. 1(*b*), when the five-opening air valve 12 turns on the first channel and the third channel and turns off the second channel and the fourth channel, the exhauster 14 exhausts the second closed space 96 through the third channel and the second soft pipe 1207, the third sectioning plate 98 uses the atmospheric pressure to move toward the fourth sectioning plate 100 and uses the second connecting rod 80, the first sleeving axle 82, and the third sleeving axle 86 to downward swing the first power lever 76, the atmospheric pressure inflates the first closed space 88 through the first channel and the first soft pipe 1206, and the first sectioning plate 90 uses the atmospheric pressure to move away from the second sectioning plate 92 and uses the first connecting rod 78, the first sleeving axle 82, and the second sleeving axle 84 to upward swing the first power lever 76. Thus, the first power lever 76 rotates clockwise. In the first embodiment, the force produced by the first expandable chamber 16 and the second expandable chamber 18 is a couple since the total area of the first sectioning plate 90 and the third sectioning plate 98 is two times of the area of the first sectioning plate 90 or the third sectioning plate 98. The couple is two times of the force produced by the first expandable chamber 16 or the second expandable chamber 18. In addition, the volume of the first expandable chamber 16 or the second expandable chamber 18 is small, the first expandable chamber 16 or the second expandable chamber 18 does not generate friction when expanding or contracting. In other words, the present invention can accumulate force and avoid the consuming energy and occupying a very a large space.

Figure 2A:
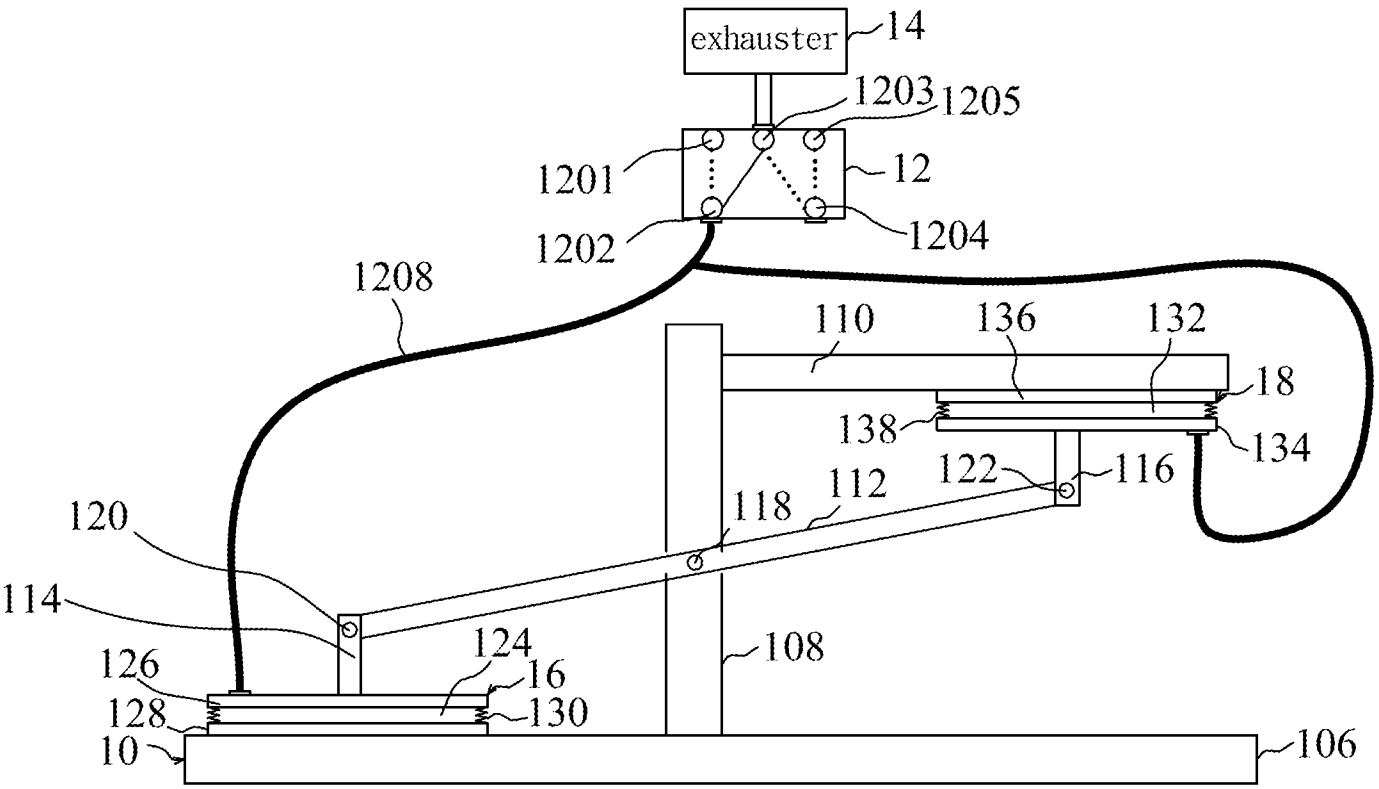
FIG. 2(*a*) is a diagram schematically showing a device for accumulating atmospheric pressure while exhausting a first expandable chamber and a second expandable chamber according to the second embodiment of the present invention.
Figure 2B:
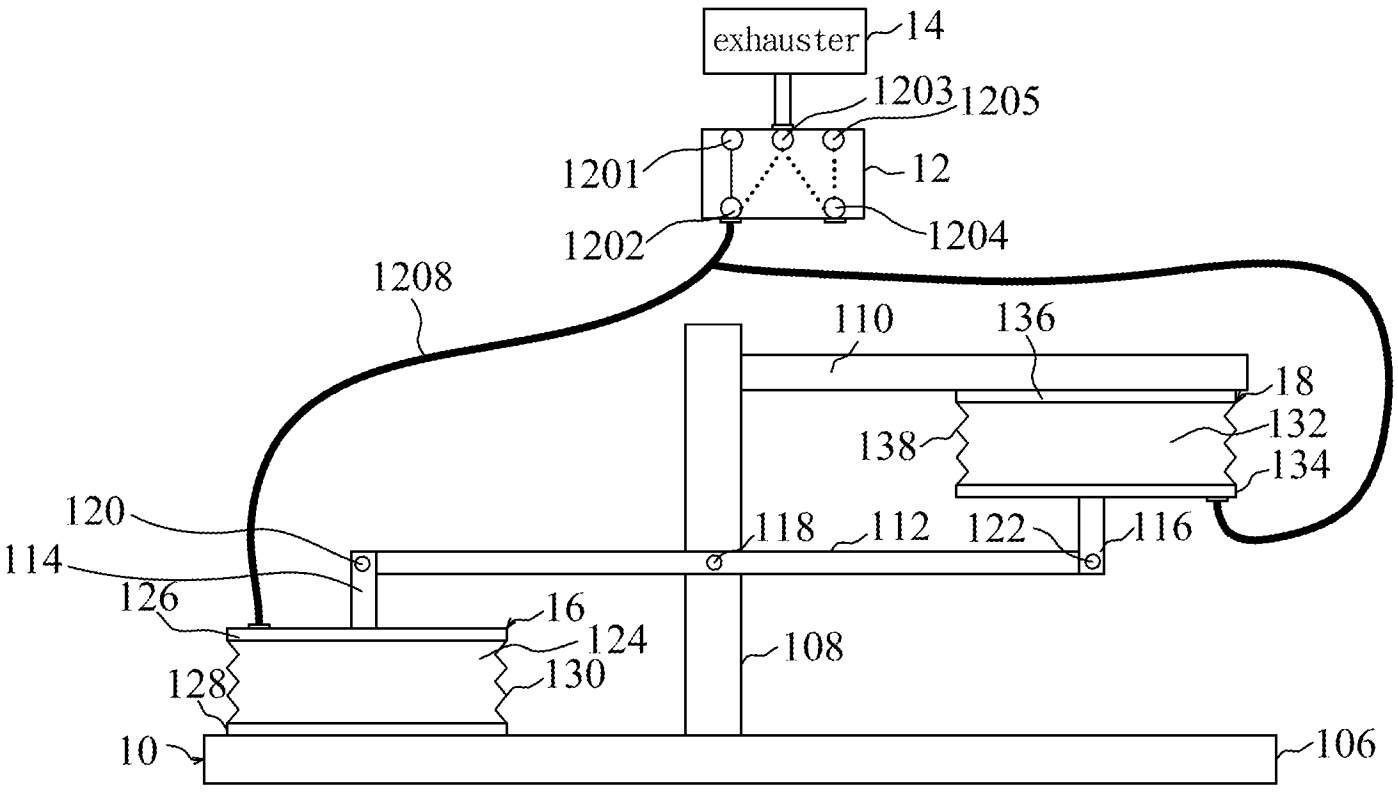

Refer to FIG. 2(*a*) and FIG. 2(*b*). The second embodiment of the device for accumulating atmospheric pressure is introduced as follows. The device for accumulating atmospheric pressure comprises a supporting device 10, at least two expandable chambers, a five-opening air valve 12, and an exhauster 14. The number of the expandable chambers is an even number. The expandable chambers are uniformly arranged at two opposite sides of the supporting device 10. Thus, not affected by the weight of the supporting device 10, the expandable chambers expand or contract. In the second embodiment, the expandable chambers comprise a first expandable chamber 16 and a second expandable chamber 18 installed on the supporting device 10. The five-opening air valve 12 has a first opening 1201, a second opening 1202, a third opening 1203, a fourth opening 1204, a fifth opening 1205, a first channel connected between the first opening 1201 and the second opening 1202, a second channel connected between the second opening 1202 and the third opening 1203, a third channel connected between the third opening 1203 and the fourth opening 1204, and a fourth channel connected between the fourth opening 1204 and the fifth opening 1205. The second opening 1202 is connected with the first expandable chamber 16 and the second expandable chamber 18 through a first soft pipe 1208, so as to communicate with the internal spaces of the first expandable chamber 16 and the second expandable chamber 18. The first opening 1201 and the fifth opening 1205 receive the atmospheric pressure. The exhauster 14 connects and communicates with the third opening 1203. The first opening 1201 and the fifth opening 1205 receive the atmospheric pressure. The five-opening air valve 12 may be a manual air valve or an electric air valve. According to the switching state of the five-opening air valve 12, the exhauster 14 exhausts the internal space of the first expandable chamber 16 and the second expandable chamber 18 through the five-opening air valve 12 or the atmospheric pressure inflates the internal space of the first expandable chamber 16 and the second expandable chamber 18 through the five-opening air valve 12, thereby driving the supporting device 10.

Specifically, the supporting device 10 further comprises a supporting base 106, a supporting post 108, a first supporting board 110, a first power lever 112, a first connecting rod 114, a second connecting rod 116, a first sleeving axle 118, a second sleeving axle 120, and a third sleeving axle 122. The first interior of the first expandable chamber 16 has a first closed space 124. The first exterior of the first expandable chamber 16 has a first sectioning plate 126, a second sectioning plate 128 opposite to the first sectioning plate 126, and a first expandable material 130. The second opening 1202 is connected with the first expandable chamber 16 through the first soft pipe 1208, so as to communicate with the first closed space 124. The first sectioning plate 126 and the second sectioning plate 128 are made of rigid material, such as stainless. The first expandable material 130 is soft and airtight. For example, the first expandable material 130 may be plastic. The first expandable material 130 is connected with the first sectioning plate 126 and the second sectioning plate 128. The first expandable material 130, the first sectioning plate 126, and the second sectioning plate 128 form the first closed space 124. The second interior of the second expandable chamber 18 has a second closed space 132. The second exterior of the second expandable chamber 18 has a third sectioning plate 134, a fourth sectioning plate 136 opposite to the third sectioning plate 134, and a second expandable material 138. The second opening 1202 is connected with the second expandable chamber 18 through the first soft pipe 1208, so as to communicate with the second closed space 132. The third sectioning plate 134 and the fourth sectioning plate 136 are made of rigid material, such as stainless. The second expandable material 138 is soft and airtight. For example, the second expandable material 138 may be plastic. The second expandable material 138 is connected with the third sectioning plate 134 and the fourth sectioning plate 136. The second expandable material 138, the third sectioning plate 134, and the fourth sectioning plate 136 form the second closed space 132.

The supporting base 106 is fixed with the second sectioning plate 128 thereon. The supporting post 108 is fixed on the supporting base 106 and vertically connected with the supporting base 106. The supporting post 108 is penetrated with the first sleeving axle 118. The first expandable chamber 16 and the second expandable chamber 18 are respectively arranged at two opposite sides of the supporting post 108. The first supporting board 110 and the first expandable chamber 16 are located at two opposite sides of the supporting post 108 and vertically connected with the supporting post 108. The first supporting board 110 and the second expandable chamber 18 are located at the identical side of the supporting post 108. The fourth sectioning plate 136 is fixed to the first supporting board 110. The second expandable chamber 18 is located between the first supporting board 110 and the supporting base 106. The first power lever 112 sleeves the first sleeving axle 118, two ends of the first power lever 112 are respectively penetrated with the second sleeving axle 120 and the third sleeving axle 122, and the first sleeving axle 118 is located between the second sleeving axle 120 and the third sleeving axle 122. An end of the first connecting rod 114 sleeves the second sleeving axle 120, and another end of the first connecting rod 114 is fixed to the first sectioning plate 126. An end of the second connecting rod 116 sleeves the third sleeving axle 122, and another end of the second connecting rod 116 is fixed to the third sectioning plate 134.

The operation of the device for accumulating atmospheric pressure of the second embodiment of the present invention is introduced as follows. As shown in FIG. 2(*a*), when the five-opening air valve 12 turns off the first channel and turns on the second channel, the exhauster 14 exhausts the first closed space 124 and the second closed space 132 through the second channel and the first soft pipe 1208, and the first sectioning plate 126 and the third sectioning plate 134 use the atmospheric pressure to respectively move toward the second sectioning plate 128 and the fourth sectioning plate 136 and use the first connecting rod 114, the second connecting rod 116, the first sleeving axle 118, the second sleeving axle 120, and the third sleeving axle 122 to downward swing the first power lever 112. Thus, the first power lever 112 rotates counterclockwise. As shown in FIG. 2(*b*), when the five-opening air valve 12 turns on the first channel and turns off the second channel, the atmospheric pressure inflates the first closed space 124 and the second closed space 132 through the first channel and the first soft pipe 1208, and the first sectioning plate 126 and the third sectioning plate 134 use the atmospheric pressure to respectively move away from the second sectioning plate 128 and the fourth sectioning plate 136 and use the first connecting rod 114, the second connecting rod 116, the first sleeving axle 118, the second sleeving axle 120, and the third sleeving axle 122 to swing the first power lever 112. Thus, the first power lever 112 rotates clockwise. In the second embodiment, the force produced by the first expandable chamber 16 and the second expandable chamber 18 is a couple since the total area of the first sectioning plate 126 and the third sectioning plate 134 is two times of the area of the first sectioning plate 126 or the third sectioning plate 134. The couple is two times of the force produced by the first expandable chamber 16 or the second expandable chamber 18. In addition, the volume of the first expandable chamber 16 or the second expandable chamber 18 is small, the first expandable chamber 16 or the second expandable chamber 18 does not generate friction when expanding or contracting. In other words, the present invention can accumulate force and avoid the consuming energy and occupying a very a large space.

Figure 3A:
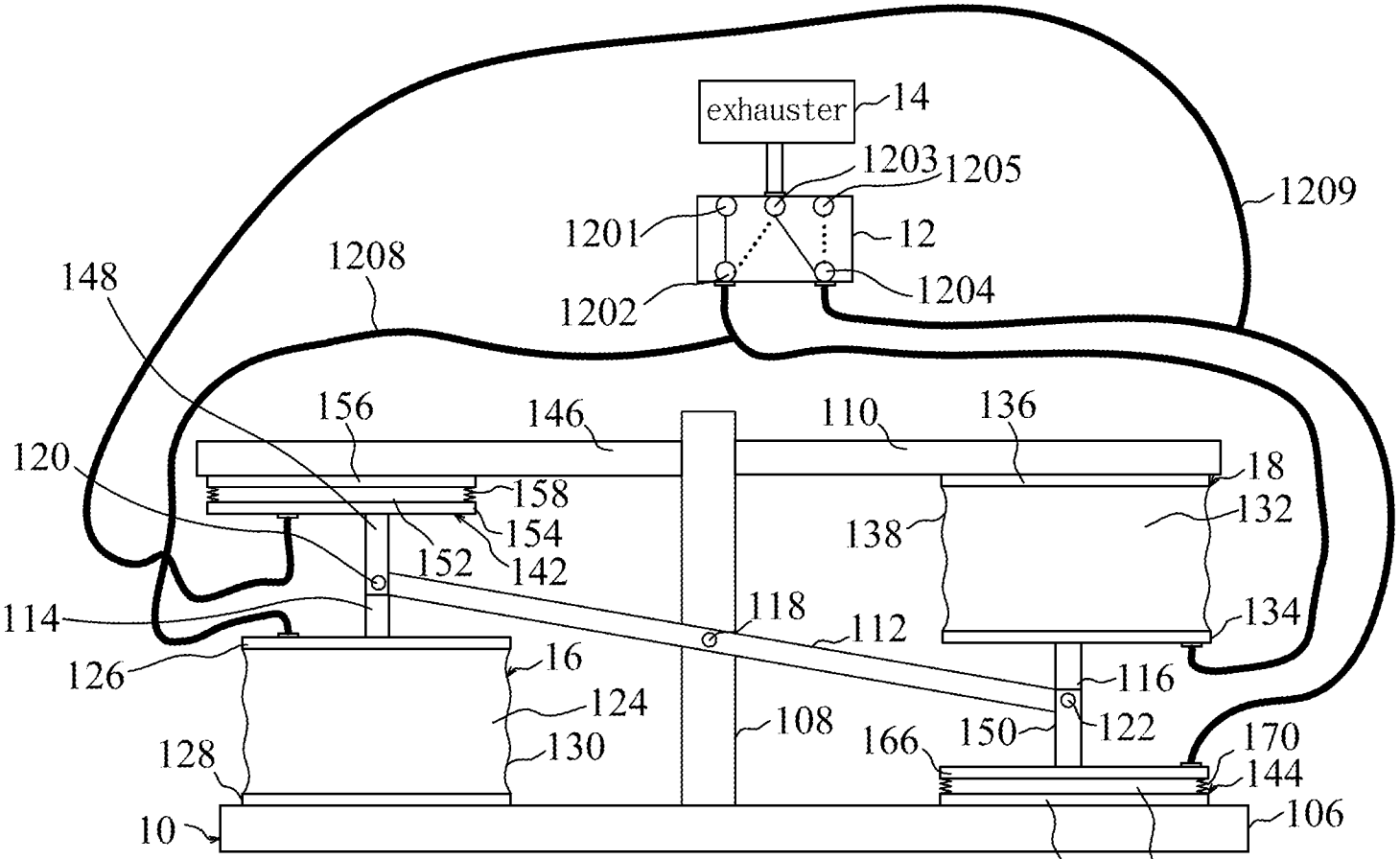
FIG. 3(*a*) is a diagram schematically showing a device for accumulating atmospheric pressure while inflating a first expandable chamber and a second expandable chamber and exhausting a third expandable chamber a fourth expandable chamber according to the third embodiment of the present invention.
Figure 3B:
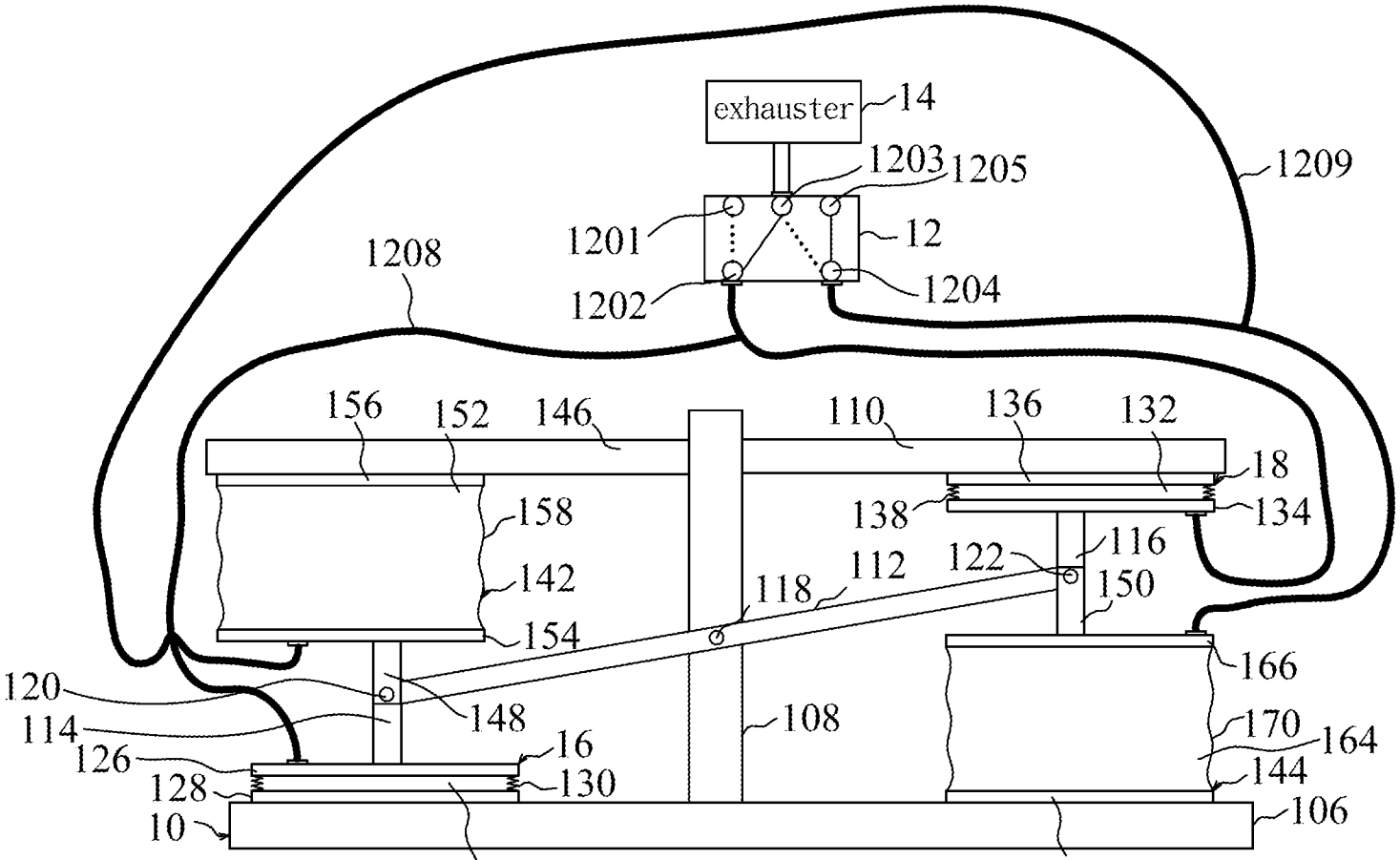

Refer to FIG. 3(*a*) and FIG. 3(*b*). The third embodiment of the device for accumulating atmospheric pressure is introduced as follows. The third embodiment is different from the second embodiment in the expandable chambers and the supporting device 10. In the third embodiment, the expandable chambers further comprise a third expandable chamber 142 and a fourth expandable chamber 144, and the supporting device 10 further comprises a second supporting board 146, a third connecting rod 148, and a fourth connecting rod 150.

The third interior of the third expandable chamber 142 has a third closed space 152, the third exterior of the third expandable chamber 142 has a fifth sectioning plate 154, a sixth sectioning plate 156 opposite to the fifth sectioning plate 154, and a third expandable material 158. The third expandable chamber 142 and the first expandable chamber 16 are arranged at the identical side of the supporting post 108, and the fourth opening 1204 connects with the third expandable chamber 142 to communicate with the third closed space 152 through a second soft pipe 1209. The fifth sectioning plate 154 and the sixth sectioning plate 156 are made of rigid material, such as stainless. The third expandable material 158 is soft and airtight. For example, the third expandable material 158 may be plastic. The third expandable material 158 is connected with the fifth sectioning plate 154 and the sixth sectioning plate 156. The third expandable material 158, the fifth sectioning plate 154 and the sixth sectioning plate 156 form the third closed space 152. The fourth interior of the fourth expandable chamber 144 has a fourth closed space 164, the fourth exterior of the fourth expandable chamber 144 has a seventh sectioning plate 166, an eighth sectioning plate 168 opposite to the seventh sectioning plate 166, and a fourth expandable material 170. The fourth expandable chamber 144 and the second expandable chamber 18 are arranged at the identical side of the supporting post 108. The eighth sectioning plate 168 is fixed on the supporting base 106. The fourth opening 1204 connects with the fourth expandable chamber 144 to communicate with the fourth closed space 164 through the second soft pipe 1209. The seventh sectioning plate 166 and the eighth sectioning plate 168 are made of rigid material, such as stainless. The fourth expandable material 170 is soft and airtight. For example, the fourth expandable material 170 may be plastic. The fourth expandable material 170 is connected with the seventh sectioning plate 166 and the eighth sectioning plate 168. The fourth expandable material 170, the seventh sectioning plate 166, and the eighth sectioning plate 168 form the fourth closed space 164.

The second supporting board 146 and the first expandable chamber 16 are located at the identical side of the supporting post 108 and the second supporting board 146 is vertically connected with the supporting post 108. The sixth sectioning plate 156 is fixed on the second supporting board 146, and the third expandable chamber 12 is arranged between the second supporting board 146 and the supporting base 106. An end of the third connecting rod 148 sleeves the second sleeving axle 120, and another end of the third connecting rod 148 is fixed to the fifth sectioning plate 154. An end of the fourth connecting rod 150 sleeves the third sleeving axle 122, and another end of the fourth connecting rod 150 is fixed to the seventh sectioning plate 166.

The operation of the device for accumulating atmospheric pressure of the third embodiment of the present invention is introduced as follows.

As shown in FIG. 3(*a*), when the five-opening air valve 12 turns off the fourth channel and turns on the third channel, the exhauster 14 exhausts the third closed space 152 and the fourth closed space 164 through the third channel and the second soft pipe 1209, and the fifth sectioning plate 154 and the seventh sectioning plate 166 use the atmospheric pressure to respectively move toward the sixth sectioning plate 156 and the eighth sectioning plate 168 and use the third connecting rod 148, the fourth connecting rod 150, the first sleeving axle 118, the second sleeving axle 120, and the third sleeving axle 122 to swing the first power lever 112. Thus, the first power lever 112 rotates clockwise. Simultaneously, the five-opening air valve 12 turns on the first channel and turns off the second channel, the atmospheric pressure inflates the first closed space 124 and the second closed space 132 through the first channel and the first soft pipe 120, and the first sectioning plate 126 and the third sectioning plate 134 use the atmospheric pressure to respectively move away from the second sectioning plate 128 and the fourth sectioning plate 136 and use the first connecting rod 114, the second connecting rod 116, the first sleeving axle 118, the second sleeving axle 120, and the third sleeving axle 122 to swing the first power lever 112. Thus, the first power lever 112 rotates clockwise.

As shown in FIG. 3(*b*), when the five-opening air valve 12 turns on the fourth channel and turns off the third channel, the atmospheric pressure inflates the third closed space 152 and the fourth closed space 164 through the fourth channel and the second soft pipe 1209, and the fifth sectioning plate 154 and the seventh sectioning plate 166 use the atmospheric pressure to respectively move away from the sixth sectioning plate 156 and the eighth sectioning plate 168 and use the third connecting rod 148, the fourth connecting rod 150, the first sleeving axle 118, the second sleeving axle 120, and the third sleeving axle 122 to swing the first power lever 112. Thus, the first power lever 112 rotates counterclockwise. Simultaneously, the five-opening air valve 12 turns off the first channel and turns on the second channel, the exhauster 14 exhausts the first closed space 124 and the second closed space 132 through the second channel and the first soft pipe 1208, and the first sectioning plate 126 and the third sectioning plate 134 use the atmospheric pressure to respectively move toward the second sectioning plate 128 and the fourth sectioning plate 136 and use the first connecting rod 114, the second connecting rod 116, the first sleeving axle 118, the second sleeving axle 120, and the third sleeving axle 122 to swing the first power lever 112. Thus, the first power lever 112 rotates counterclockwise. In the third embodiment, there are four expandable chambers whose total area is larger. As a result, more force can be accumulated.

The device for accumulating atmospheric pressure of the present invention may be applied to an electricity generation device or a kinetic energy device. For example, in the abovementioned embodiments, the supporting device 10 is combined with an electricity generation device or a kinetic energy device. The electricity generation device or the kinetic energy device uses kinetic energy generated by the supporting device to operate.

In conclusion, the present invention uses the exhauster to exhaust the internal spaces of at least two expandable chambers or uses atmospheric pressure to inflate the internal spaces of the expandable chambers, thereby accumulating force, avoiding the consumption of energy, and occupying a very large space.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A device for accumulating atmospheric pressure, comprising:

a supporting device;

at least two expandable chambers installed on the supporting device, the number of the at least two expandable chambers is an even number, and the at least two expandable chambers are uniformly arranged at two opposite sides of the supporting device;

a five-opening air valve connected with the at least two expandable chambers to communicate with internal spaces of the at least two expandable chambers, and receiving atmospheric pressure; and an exhauster connecting and communicating with the five-opening air valve, wherein the five-opening air valve has a first opening, a second opening, a third opening, a fourth opening, a fifth opening, a first channel connected between the first opening and the second opening, a second channel connected between the second opening and the third opening, a third channel connected between the third opening and the fourth opening, and a fourth channel connected between the fourth opening and the fifth opening, the second opening is connected with the at least two expandable chambers to communicate with the internal spaces of the at least two expandable chambers, the first opening and the fifth opening receive the atmospheric pressure, the exhauster is connected with the third opening, and the at least two expandable chambers further comprises:

a first expandable chamber with a first interior thereof having a first closed space, a first exterior of the first expandable chamber has a first sectioning plate and a second sectioning plate opposite to the first sectioning plate, and the second opening connects with the first expandable chamber to communicate with the first closed space through a first soft pipe; and a second expandable chamber with a second interior thereof having a second closed space, a second exterior of the second expandable chamber has a third sectioning plate and a fourth sectioning plate opposite to the third sectioning plate, and the second opening connects with the second expandable chamber to communicate with the second closed space through the first soft pipe; and the supporting device further comprises:

a supporting base fixed with the second sectioning plate thereon;

a supporting post fixed on the supporting base and vertically connected with the supporting base, the supporting post is penetrated with a first sleeving axle, and the first expandable chamber and the second expandable chamber are respectively arranged at two opposite sides of the supporting post;

a first supporting board vertically connected with the supporting post, the first supporting board and the first expandable chamber are respectively arranged at the two opposite sides of the supporting post, the first supporting board and the second expandable chamber are arranged at an identical side of the supporting post, the fourth sectioning plate is fixed to the first supporting board, and the second expandable chamber is arranged between the first supporting board and the supporting base;

a first power lever sleeving the first sleeving axle, two ends of the first power lever are respectively penetrated with a second sleeving axle and a third sleeving axle, and the first sleeving axle is located between the second sleeving axle and the third sleeving axle;

a first connecting rod with an end thereof sleeving the second sleeving axle, and another end of the first connecting rod is fixed to the first sectioning plate; and a second connecting rod with an end thereof sleeving the third sleeving axle, and another end of the second connecting rod is fixed to the third sectioning plate; when the five-opening air valve turns off the first channel and turns on the second channel, the exhauster exhausts the first closed space and the second closed space through the second channel and the first soft pipe, and the first sectioning plate and the third sectioning plate use the atmospheric pressure to respectively move toward the second sectioning plate and the fourth sectioning plate and use the first connecting rod, the second connecting rod, the first sleeving axle, the second sleeving axle, and the third sleeving axle to swing the first power lever; and when the five-opening air valve turns on the first channel and turns off the second channel, the atmospheric pressure inflates the first closed space and the second closed space through the first channel and the first soft pipe, and the first sectioning plate and the third sectioning plate use the atmospheric pressure to respectively move away from the second sectioning plate and the fourth sectioning plate and use the first connecting rod, the second connecting rod, the first sleeving axle, the second sleeving axle, and the third sleeving axle to swing the first power lever.

2. The device for accumulating atmospheric pressure according to claim 1, wherein the first expandable chamber further comprises a first expandable material connected with the first sectioning plate and the second sectioning plate, the first expandable material, the first sectioning plate, and the second sectioning plate form the first closed space, the second expandable chamber further comprises a second expandable material connected with the third sectioning plate and the fourth sectioning plate, and the second expandable material, the third sectioning plate, and the fourth sectioning plate form the second closed space.

3. The device for accumulating atmospheric pressure according to claim 1, wherein the at least two expandable chambers further comprise:

a third expandable chamber with a third interior thereof having a third closed space, a third exterior of the third expandable chamber has a fifth sectioning plate and a sixth sectioning plate opposite to the fifth sectioning plate, the third expandable chamber and the first expandable chamber are arranged at an identical side of the supporting post, and the fourth opening connects with the third expandable chamber to communicate with the third closed space through a second soft pipe; and a fourth expandable chamber with a fourth interior thereof having a fourth closed space, a fourth exterior of the fourth expandable chamber has a seventh sectioning plate and an eighth sectioning plate opposite to the seventh sectioning plate, the fourth expandable chamber and the second expandable chamber are arranged at an identical side of the supporting post, the eighth sectioning plate is fixed on the supporting base, and the fourth opening connects with the fourth expandable chamber to communicate with the fourth closed space through the second soft pipe; and the supporting device further comprises:

a second supporting board vertically connected with the supporting post, the second supporting board and the first expandable chamber are arranged at an identical side of the supporting post, the sixth sectioning plate is fixed on the second supporting board, and the third expandable chamber is arranged between the second supporting board and the supporting base;

a third connecting rod with an end thereof sleeving the second sleeving axle, and another end of the third connecting rod is fixed to the fifth sectioning plate; and a fourth connecting rod with an end thereof sleeving the third sleeving axle, and another end of the fourth connecting rod is fixed to the seventh sectioning plate; when the five-opening air valve turns off the fourth channel and turns on the third channel, the exhauster exhausts the third closed space and the fourth closed space through the third channel and the second soft pipe, and the fifth sectioning plate and the seventh sectioning plate use the atmospheric pressure to respectively move toward the sixth sectioning plate and the eighth sectioning plate and use the third connecting rod, the fourth connecting rod, the first sleeving axle, the second sleeving axle, and the third sleeving axle to swing the first power lever; and when the five-opening air valve turns on the fourth channel and turns off the third channel, the atmospheric pressure inflates the third closed space and the fourth closed space through the fourth channel and the second soft pipe, and the fifth sectioning plate and the seventh sectioning plate use the atmospheric pressure to respectively move away from the sixth sectioning plate and the eighth sectioning plate and use the third connecting rod, the fourth connecting rod, the first sleeving axle, the second sleeving axle, and the third sleeving axle to swing the first power lever.

4. The device for accumulating atmospheric pressure according to claim 3, wherein the third expandable chamber further comprises a third expandable material connected with the fifth sectioning plate and the sixth sectioning plate, the third expandable material, the fifth sectioning plate, and the sixth sectioning plate form the third closed space, the fourth expandable chamber further comprises a fourth expandable material connected with the seventh sectioning plate and the eighth sectioning plate, and the fourth expandable material, the seventh sectioning plate, and the eighth sectioning plate form the fourth closed space.

5. The device for accumulating atmospheric pressure according to claim 1, wherein the five-opening air valve is a manual air valve or an electric air valve.

6. The device for accumulating atmospheric pressure according to claim 1, wherein the supporting device is combined with an electricity generation device or a kinetic energy device, and the electricity generation device or the kinetic energy device uses kinetic energy generated by the supporting device to operate.

7. A device for accumulating atmospheric pressure comprising:

a supporting device;

at least two expandable chambers installed on the supporting device, the number of the at least two expandable chambers is an even number, and the at least two expandable chambers are uniformly arranged at two opposite sides of the supporting device;

a five-opening air valve connected with the at least two expandable chambers to communicate with internal spaces of the at least two expandable chambers, and receiving atmospheric pressure; and an exhauster connecting and communicating with the five-opening air valve, and according to a switching state of the five-opening air valve, the exhauster exhausts the internal space of one of the at least two expandable chambers through the five-opening air valve and the atmospheric pressure inflates the internal space of an other one of the at least two expandable chambers through the five-opening air valve, thereby driving the supporting device.

8. The device for accumulating atmospheric pressure according to claim 7, wherein the five-opening air valve has a first opening, a second opening, a third opening, a fourth opening, a fifth opening, a first channel connected between the first opening and the second opening, a second channel connected between the second opening and the third opening, a third channel connected between the third opening and the fourth opening, and a fourth channel connected between the fourth opening and the fifth opening, the second opening and the fourth opening are respectively connected with the at least two expandable chambers to communicate with the internal spaces of the at least two expandable chambers, the first opening and the fifth opening receive the atmospheric pressure, the exhauster is connected with the third opening, and the at least two expandable chambers further comprise:

a first expandable chamber with a first interior thereof having a first closed space, a first exterior of the first expandable chamber has a first sectioning plate and a second sectioning plate opposite to the first sectioning plate, and the second opening connects with the first expandable chamber to communicate with the first closed space through a first soft pipe; and a second expandable chamber with a second interior thereof having a second closed space, a second exterior of the second expandable chamber has a third sectioning plate and a fourth sectioning plate opposite to the third sectioning plate, and the fourth opening connects with the second expandable chamber to communicate with the second closed space through a second soft pipe; and the supporting device further comprises:

a supporting base fixed with the second sectioning plate thereon;

a supporting post fixed on the supporting base and vertically connected with the supporting base, the supporting post is penetrated with a first sleeving axle, the first expandable chamber and the second expandable chamber are respectively arranged at two opposite sides of the supporting post, and the fourth sectioning plate is fixed to the supporting base;

a first power lever sleeving the first sleeving axle, two ends of the first power lever are respectively penetrated with a second sleeving axle and a third sleeving axle, and the first sleeving axle is located between the second sleeving axle and the third sleeving axle;

a first connecting rod with an end thereof sleeving the second sleeving axle, and another end of the first connecting rod is fixed to the first sectioning plate; and a second connecting rod with an end thereof sleeving the third sleeving axle, and another end of the second connecting rod is fixed to the third sectioning plate; when the five-opening air valve turns off the first channel and the third channel and turns on the second channel and the fourth channel, the exhauster exhausts the first closed space through the second channel and the first soft pipe, the first sectioning plate uses the atmospheric pressure to move toward the second sectioning plate and uses the first connecting rod, the first sleeving axle, and the second sleeving axle to swing the first power lever, the atmospheric pressure inflates the second closed space through the fourth channel and the second soft pipe, and the third sectioning plate uses the atmospheric pressure to move away from the fourth sectioning plate and uses the second connecting rod, the first sleeving axle, and the third sleeving axle to swing the first power lever; and when the five-opening air valve turns on the first channel and the third channel and turns off the second channel and the fourth channel, the exhauster exhausts the second closed space through the third channel and the second soft pipe, the third sectioning plate uses the atmospheric pressure to move toward the fourth sectioning plate and uses the second connecting rod, the first sleeving axle, and the third sleeving axle to swing the first power lever, the atmospheric pressure inflates the first closed space through the first channel and the first soft pipe, and the first sectioning plate uses the atmospheric pressure to move away from the second sectioning plate and uses the first connecting rod, the first sleeving axle, and the second sleeving axle to swing the first power lever.

9. The device for accumulating atmospheric pressure according to claim 8, wherein the first expandable chamber further comprises a first expandable material connected with the first sectioning plate and the second sectioning plate, the first expandable material, the first sectioning plate, and the second sectioning plate form the first closed space, the second expandable chamber further comprises a second expandable material connected with the third sectioning plate and the fourth sectioning plate, and the second expandable material, the third sectioning plate, and the fourth sectioning plate form the second closed space.

* * * * *